United States Patent [19]

Koinuma et al.

[11] 4,287,451

[45] Sep. 1, 1981

[54] MAGNETRON HAVING IMPROVED INTERCONNECTING ANODE VANES

[75] Inventors: Tokuju Koinuma; Akira Kousaka, both of Kawasaki, Japan

[73] Assignee: Toshiba Corporation, Kawasaki, Japan

[21] Appl. No.: 97,958

[22] Filed: Nov. 28, 1979

[51] Int. Cl.[3] ..... H01J 23/22

[52] U.S. Cl. ..... 315/39.69; 315/39.51; 315/39.75

[58] Field of Search ..... 315/39.69, 39.75, 39.51

[56] References Cited

U.S. PATENT DOCUMENTS

| | | | |
|---|---|---|---|
| 2,535,713 | 12/1950 | Wooten | 315/39.69 X |
| 2,852,720 | 9/1958 | Crapuchettes | 315/39.75 |
| 3,875,469 | 4/1975 | Sato et al. | 315/39.69 |
| 4,041,350 | 8/1977 | Shitara et al. | 315/39.75 |
| 4,063,129 | 12/1977 | Miura et al. | 315/39.69 |
| 4,109,179 | 8/1978 | McKinnon | 315/39.75 |

*Primary Examiner*—Saxfield Chatmon, Jr.
*Attorney, Agent, or Firm*—Schuyler, Banner, Birch, McKie & Beckett

[57] ABSTRACT

A magnetron comprises an anode having an inner cylindrical wall and a plurality of copper vanes extending inwardly from the inner cylindrical wall, each vane having a notch in the top and bottom edges thereof. Each notch has an inner side edge, an outer side edge and a bottom edge. Inner and outer ring straps made of metal having a larger tensile strength than the vanes are placed in the notches. The inner ring strap is fixed to the inner side edge of alternative vanes. The inner side edge also has a slanting edge between the connection of the inner ring strap and the bottom edge to prevent cracking.

7 Claims, 5 Drawing Figures

FIG. 1
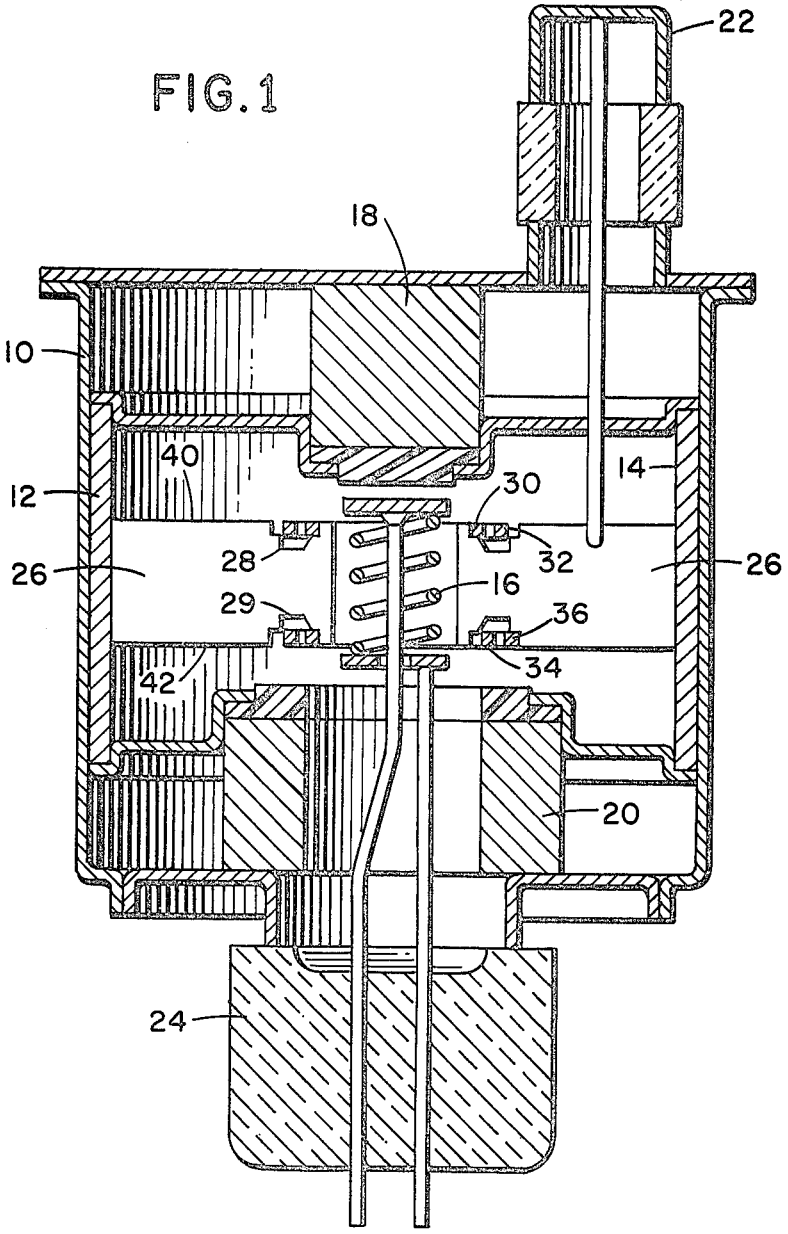
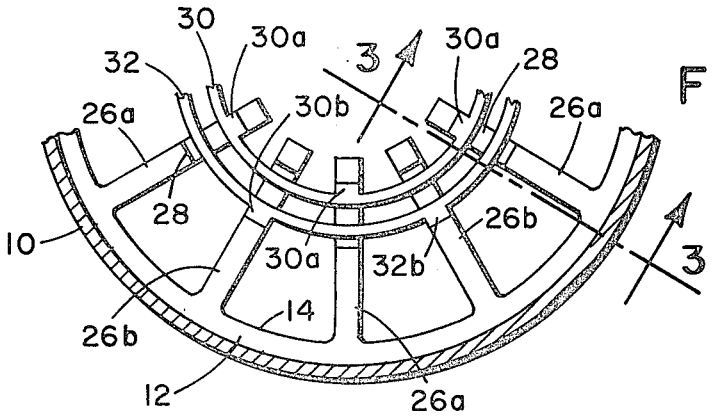
FIG. 2

MAGNETRON HAVING IMPROVED INTERCONNECTING ANODE VANES

BACKGROUND OF THE INVENTION

This invention relates to a magnetron having an anode with a plurality of vanes interconnected by ring straps.

Magnetrons are generally provided with a cylindrical anode having a plurality of radial vanes extending in an inward direction. These vanes create spaces within anode which function as multi resonating cavities. A cathode is positioned along the axis of the anode and an interaction space is formed between free edges of the vanes and the cathode. Double straps are connected between the top and bottom edges of alternate vanes in the anode to enhance operation of the magnetron. These straps are located in notches on the top and bottom edges of the vanes.

In operation, an elcetric field is formed between the anode and the cathode and a magnetic field is formed along the axis of the anode through the interaction space. Electrons from the cathode are bunched together in a spoke-like shape around the interaction space to induce microwave energy in the cavities between the anode vanes. The vanes capture electrons and, as a result, heat is generated at the free edges of the vanes. About 40% of the power of the magnetron is lost in heat a t the anode vanes.

As shown in the conventional magnetron in FIG. 5, the vanes 1 are connected to the cylindrical anode 12. When the vanes 1 are heated during operation of the magnetron, the vanes 1 expand inwardly as indicated with the arrow $F_1$, while the straps 3 and 4 expand outwardly in the opposite direction as indicated by the arrow $F_2$. As a result, a component force $(F_1+F_2)$ is concentrated in the corner portion $1_a$ of the vanes 1. These vanes 1 are connected together by strap 3. Whenever the magnetron is turned on and off, a heat cycle occurs which adds force to the corner portions $1_a$ of the vanes 1 and the strap 3. Consequently the corner portion $1_a$ is stretched outwardly by the strap 3 resulting in either a crack 5 in the vane 1 or strap separation where the straps 3 and 4 tear off the vane 1. In either event, the magnetron stops oscillating and producing microwave energy. Vane cracks and strap separation especially occur in internal magnet type magnetrons having an anode enclosed within a magnetic cylinder, such as iron, having a lower coefficient of expansion than that of the anode and the vanes.

SUMMARY OF THE INVENTION

It is an object of this invention to provide a magnetron having an anode structure which prevents vane cracks. It is a further object of this invention to provide a magnetron having an anode structure which reduces the occurance strap of separation.

In accordance with the invention, a magnetron is provided with a cylindrical anode and a cathode positioned within the anode. A plurality of metal vanes extend radially inward from an inner cylindrical wall of the anode. Each vane has a free edge facing the cathode, a top edge and bottom edge. The top and bottom edges have notches. Each notch has an inner side edge nearest the free edge of the vane, an outer side edge and a bottom edge. A plurality of metal ring straps comprising an inner ring strap and an outer ring strap are located together in each notch. The inner ring strap is placed on the inner side edge of the notches of alternate vanes and the outer ring strap is placed on the outer side edge of the notches of alternate vanes. These metal ring straps are made of metal having a tensile strength greater than that of the vanes. The inner side edge of the notches also has a slanting edge at an angle less than 90° with the bottom edge of the notch between the connection of the inner ring strap and the bottom edge of the notches.

BRIEF DESCRIPTION OF THE DRAWINGS

FIG. 1 is a vertical sectional view of a magnetron in accordance with the invention.

FIG. 2 is a fragmentary plan view of the magnetron shown in FIG. 1.

DETAILED DESCRIPTION OF THE PREFERRED EMBODIMENT

Figure 3:
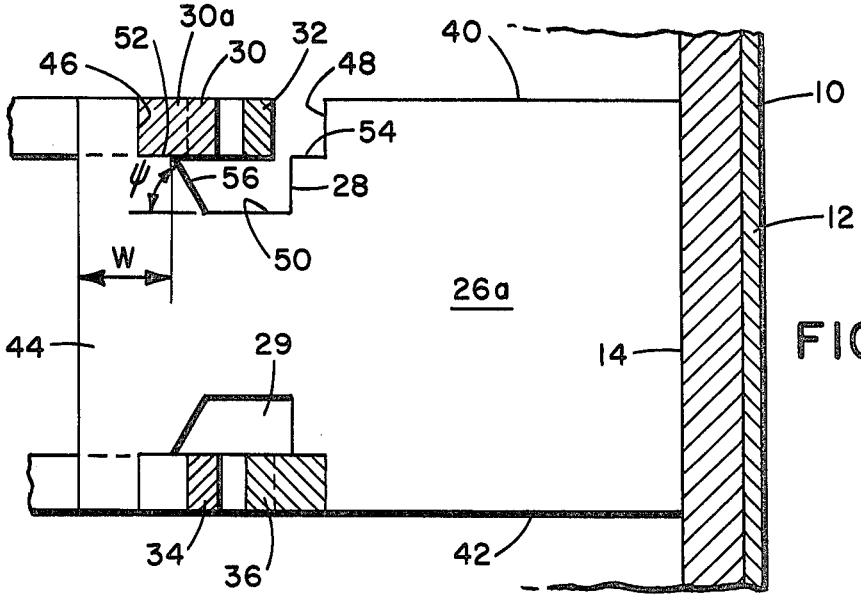
FIG. 3 is an enlarged sectional view taken along the line 3—3 of FIG. 2.

Referring now to the drawings, FIG. 1 shows a magnetron having a cylindrical magnetic envelope 10. The envelope 10 includes an anode block 12 having a cylindrical inner wall 14, a cathode 16 positioned along an axis within the anode block 12 and a pair of permanent magnets 18 and 20. An antenna portion 22 and a stem portion 24 extend from opposite ends of the envelope 10.

The anode includes a plurality of rectangular copper vanes 26 extending in a radial inward direction from the cylindrical inner wall 14. Each vane 26 is provided with notches 28 and 29 on opposite sides (i.e., the top edge 40 and the bottom edge 42). Four metal ring straps 30, 32, 34 and 36 are soldered or laser welded in the notches 28 and 29. The function of the straps 30–36 is to electrically interconnect alternate ones of the vanes 26. As shown in FIG. 2, the top inner ring strap 30 engages vanes $26_a$ and is free from contact with vanes $26_b$. The top outer ring strap 32 engages vanes $26_b$ and is free from contact with vanes $26_a$. The bottom ring straps 34 and 36 on the bottom edges of the vanes 26 also engage alternate vanes $26_a$ and $26_6$, respectively, as shown in FIG. 3.

The top inner ring strap 30 is provided with inwardly extending projections $30_a$ connected to alternate vanes $26_a$ while the top outer ring strap 32 is provided with outwardly extending projections $32_b$ connected to alternate vanes $26_b$. Each projection $30_a$ and $32_b$ has the same width as the vanes 26.

As shown in FIG. 3, each notch, such as notch 28, has an inner side edge 46 near the free edge 44 of the vanes $26_a$. The free edge 44 faces the cathode 16. An outer side edge 48 of the notch 28 faces the anode block 12 and a bottom edge 50 extends between the inner side edge 46 and the outer side edge 48. The side edges 46 and 48 terminate in steps 52 and 54, respectively. The projections $30_a$ of the top inner ring straps 30 are placed on the steps 52 and fitted to the inner side edge 46. The projections $32_b$ are placed on the steps 54 of the notches 28 of alternate vanes $26_b$. Similarly the bottom ring straps 34 and 36 are connected to the alternate vanes 26 in the notches 29 on bottom edges 42 of in notches 29.

The bottom inner ring strap 34 is connected to the inner side of the notch 29 on the bottom edge of vane $26_b$. The bottom outer ring strap 36 is connected to the outer edge of notch 29 on the bottom edge 42 of vane $26_a$. Thus, the top inner ring strap 30 and the bottom outer ring strap 36 are connected to the same vane $26_a$ as shown in FIG. 3.

In the present invention, the top and bottom inner straps 30 and 34 are made of metal having a tensile strength greater than that of the vanes 26. For example, when vanes 26 are made of copper, these inner rings straps can be formed of the following materials:

Example 1: Iron plated with copper or silver (tensile strength about 60 Kg/mm$^2$);

Example 2: A copper alloy having the proportions: Cu: about 70%, Ni: 30%, and about 0.03% Mg can be added (tensile strength about 40 Kg/mm$^2$);

Example 3: A copper alloy having the proportions: Cu: more than 95%, Zr:0.05%, Cr:0.3% (tensile strength about 60 Kg/mm$^2$);

Example 4: A copper alloy having the proportions: Cu: more than 95%, Be:0.3–2%, Co:0.3–1.5% (tensile strength about 80 to 13 Kg/mm$^2$); and Example 5: A copper alloy having the proportions: Cu: more than 95%, Ni:1.5%, Be:0.3% (tensile strength about 95 Kg/mm$^2$).

Generally, the top and bottom inner ring 30 and 34 can be formed of metal such as iron or a copper alloy consisting essentially of copper as a main component and at least one metal selected from the group consisting of Ni, Zr, Cr, Be, Co, Mg and alloys thereof.

The top and bottom outer ring straps 32 and 36 also can be formed of the same metal as in the top and bottom inner ring strap 30 and 34. The top and bottom outer ring straps also can be made of copper like the vanes 26.

The inner side edge 46 of notch 28 between the step 52 connected to the top inner ring strap 30 and the bottom edge 50 has a slanting edge 56. This edge is formed at an angle less than 90°, preferably from 30° to 60° with the bottom edge 50. In other words, the width w between the free edge 44 and inner side edge 46 gets larger toward the bottom edge 50.

In summary, the top and bottom inner and ring straps 30 and 34 are made of metal having a larger tensile strength than the vanes 26 and the inner side edge 46 of the notches 28 and 29 has a straight slanting edge 56. As a result, when stress repeatedly occurs between the vanes 26 and the ring top and bottom inner straps 30 and 34 due to the heat cycle, even if there is a different thermal expansion between vanes 26 and ring straps 30 and 34, the vanes 26 are protected from cracking. In particular, this result is produced in internal magnet type magnetrons which often have a magnetic metal envelope 10 (see FIG. 1) or a magnetic iron anode forming a magnetic path between the internal permanent magnets 18 and 20. Since iron has a smaller thermal expansion than the copper of vanes 26, the inward expansion of the vanes is larger. However, the larger tensile strength of the ring straps prevents the straps from being cut off and the slanting edge 56 prevents the vane 26 from cracking.

Figure 4:
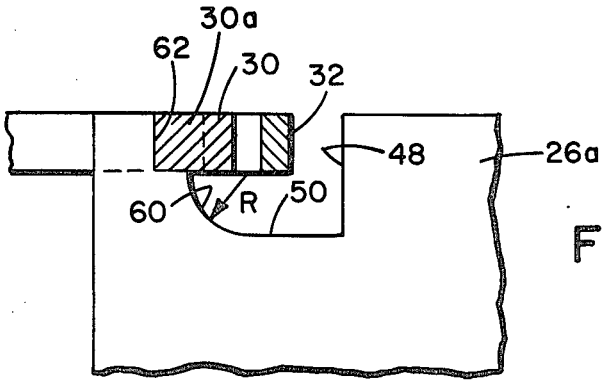
FIG. 4 is an enlarged sectional view of another embodiment of the invention.
Figure 5:
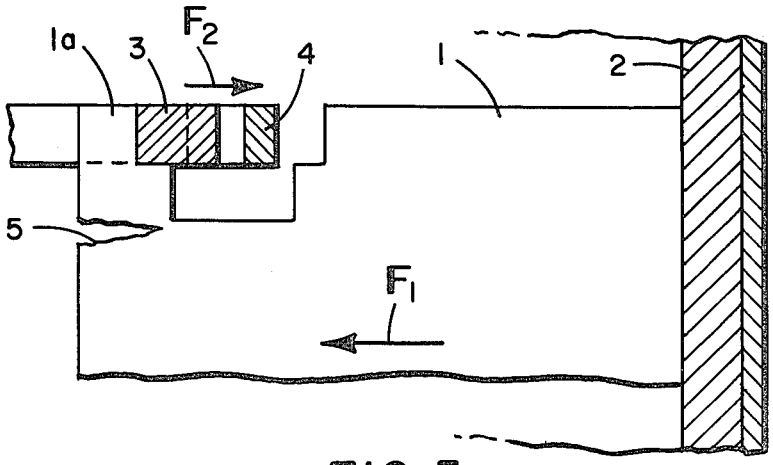
FIG. 5 PRIOR ART
FIG. 5 is an enlarged sectional view of a conventional magnetron.

Another embodiment of the present invention is illustrated in FIG. 4. Instead of the straight slanting edge 56 shown in FIG. 3, a curved edge 60 (i.e., circular arc) is formed on the inner side edge 62. The larger the radius R of the curved edge 60, the less likely cracking will occur in the vane 26. The radius R can range from 0.1mm to 1.0mm. In summary, this embodiment produces the same results as the first embodiment.

Although illustrative embodiments of the invention have been described in detail with reference to the accompanying drawings, it is to be understood that the invention is not limited to those precise embodiments and that various changes may be effected therein by one skilled in the art without departing from the scope or spirit of the present invention.

We claim:

1. In a magnetron comprising:

an anode having a cylindrical wall;

a cathode positioned within said anode;

a plurality of metal vanes extending radially inward from said cylindrical wall of said anode, said vanes having a free edge facing said cathode, a top edge and a bottom edge, at least one of said top and bottom edges of each of said vanes having a notch, said notches having an inner side edge nearest said free edge of said vanes, an outer side edge and a bottom edge;

a plurality of metal ring straps comprising an inner ring strap and an outer ring strap connected to said notches, said inner ring strap being connected to alternate ones of said plurality of metal vanes on said inner side edges of said notches of said alternate ones of said vanes and said outer ring strap being connected to different alternate vanes than said alternate ones of said plurality of metal vanes on said outer side edges of said notches of said different alternate vanes, the improvement comprising said metal ring straps being formed of metal having a tensile strength greater than the tensile strength of said vanes and said inner edge of said notches having a slanting edge at an angle less than 90° with said bottom edge of said notches between the connection of said inner ring strap and said bottom edge of said notches.

2. A magnetron according to claim 1 wherein said slanting edge is a straight line.

3. A magnetron according to claim 1 wherein said slanting edge is curved line.

4. A magnetron according to claim 1 wherein said vanes are made of copper and said ring straps consist essentially of iron.

5. A magnetron according to claim 1 wherein said vanes are made of copper and said ring straps are made of an alloy consisting essentially of copper as a main component and as least one metal selected from the group consisting of Ni, Cr, be, Co, Mg and alloys thereof.

6. A magnetron according to claim 1 wherein said inner edge of said notches comprises a step having a top portion on which said inner ring strap is placed and a side portion with a slanting edge.

7. A magnetron according to claim 1 wherein said top and bottom edges of each said vanes has a notch and said plurality of metal ring straps includes top and bottom inner ring straps and top and bottom outer ring straps, said top inner ring strap and said bottom outer ring strap being connected to the same alternate ones of said plurality of metal vanes and said top outer ring strap and said bottom inner ring strap being connected to different alternate vanes than said same alternate ones of said plurality of metal vanes, said top outer ring strap and said bottom inner ring strap also being connected to the same vanes.

* * * * *

UNITED STATES PATENT AND TRADEMARK OFFICE

CERTIFICATE OF CORRECTION

PATENT NO. : 4,287,451

DATED : September 1, 1981

INVENTOR(S) : Tokuju Koinuma et al

It is certified that error appears in the above—identified patent and that said Letters Patent is hereby corrected as shown below:

Page 1, on the face of the patent, after "[22] Filed: Nov. 28, 1979"

insert the following information

-- [30] FOREIGN APPLICATION PRIORITY DATA

December 14, 1978 Japan.....53-170899 --.

Signed and Sealed this

*Thirty-first* Day of *August 1982*

[SEAL]

*Attest:*

GERALD J. MOSSINGHOFF

*Attesting Officer* *Commissioner of Patents and Trademarks*